US005101185A

United States Patent [19]

Hofsäss

[11] Patent Number: 5,101,185

[45] Date of Patent: Mar. 31, 1992

[54] COIL CARRIER WITH SAFETY SWITCH

[76] Inventor: Peter Hofsäss, Strietweg 45, 7530 Pforzheim, Fed. Rep. of Germany

[21] Appl. No.: 637,119

[22] Filed: Jan. 3, 1991

Related U.S. Application Data

[63] Continuation of Ser. No. 340,686, Apr. 20, 1989, abandoned.

[30] Foreign Application Priority Data

Apr. 21, 1988 [DE] Fed. Rep. of Germany ... 8805272[U]

[51] Int. Cl.[5] ..... H01F 17/00

[52] U.S. Cl. ..... 336/105; 335/202

[58] Field of Search ..... 310/68 C; 335/202, 128; 336/105

[56] References Cited

U.S. PATENT DOCUMENTS 3,585,450 6/1971 Lane ..... 336/105

3,691,425 9/1972 Weyrich et al. ..... 338/192

*Primary Examiner*—Leo P. Picard

*Assistant Examiner*—Lincoln Donovan

*Attorney, Agent, or Firm*—Antonelli, Terry, Stout & Kraus

[57] ABSTRACT

A coil carrier with a receptacle for a safety switch is proposed, which has an electrically conductive mounting part (17) for the safety switch (6) with a recess (21) for the frictionally engaging reception of the safety switch (6).

11 Claims, 1 Drawing Sheet

COIL CARRIER WITH SAFETY SWITCH

This is a continuation of application Ser. No. 340,686, filed Apr. 20, 1989, abandoned.

BACKGROUND OF THE INVENTION

The invention relates to a coil carrier or support with a mount or receptacle for a safety switch.

In the case of electric coils, it is necessary to provide safety switches, such as monitors, for protecting against excess currents and temperatures. Safety switches of a complicated form have been provided on the coil carrier but have not been retained and held in a reliable manner and the contacting of the contact elements of the safety switch with the coil to be wound on the coil carrier has generally been complicated.

The aim underlying the present invention essentially resides in providing a coil carrier of the aforementioned type, which ensures a reliable hold and contacting of the safety switch, together with easy connection possibilities.

According to the invention, in a coil carrier of the aforementioned type, an electrically conducting mounting part for the safety switch is provided with a recess for the frictionally engaging reception of the safety switch. The safety switch is no longer connected as such with the coil carrier or inserted in the latter and is instead held by a mounting or retaining part, which simultaneously ensures electrical contacting by the casing shell forming one contact of the switch. Apart from these advantages, as a result of the inventive construction, the switch can be safely and reliably held on the coil carrier and in particular in a receptacle or mount thereof. In order to improve the press or friction fit of the switch in the mounting part, according to a preferred embodiment the mounting part is constructed in plate-like manner and on the plate plane is bent out a flange surrounding the recess. This ensures a flat engagement of the conductive casing on the flanges or tongues of the coil carrier. In order to increase elasticity, the mounting part has a slot extending from the recess to one outer edge.

According to a further development the mounting part is provided with noses stamped out of its plane in the marginal region. Particularly if the mounting part is guided in grooves of the coil carrier receptacle, this leads to a more reliable fixing of the safety switch and therefore provides security against it sliding out or being pulled out.

A further construction for simplification and improvement of contacting provides for the mounting part to have a connecting tongue projecting out of the receptacle and either the connecting tongue is constructed as a flat plug or a connecting tongue is constructed with a tapered portion formed by an undercut.

The inventive idea is also assisted by the receptacle having longitudinal grooves, in which is inserted the mounting part, so that it is directly possible to bring about here during winding the contacting of the winding coil with the wire of the switch.

BRIEF DESCRIPTION OF THE DRAWINGS

Further advantages and features of the invention can be gathered from the claims and description of embodiments of the invention with reference to the drawings, wherein:

DESCRIPTION OF PREFERRED EMBODIMENT

Figure 1:
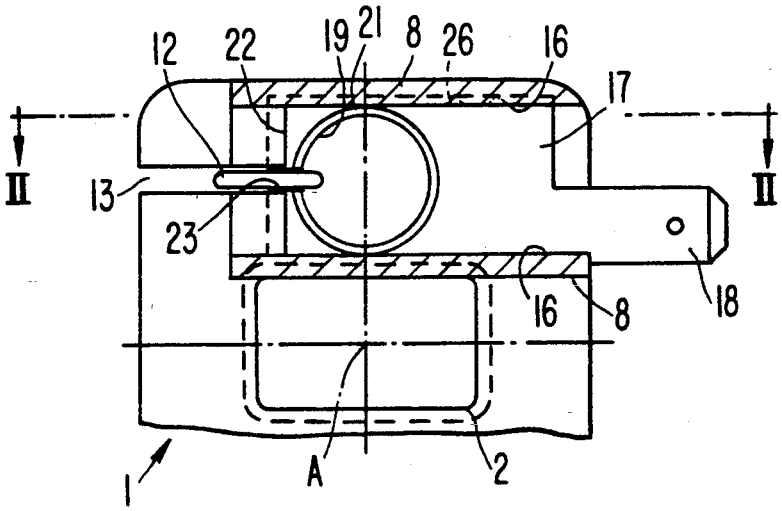
FIG. 1 is a partial cross-sectional view taken in a direction of the coil axis along the line I—I in FIG. 2.
Figure 2:
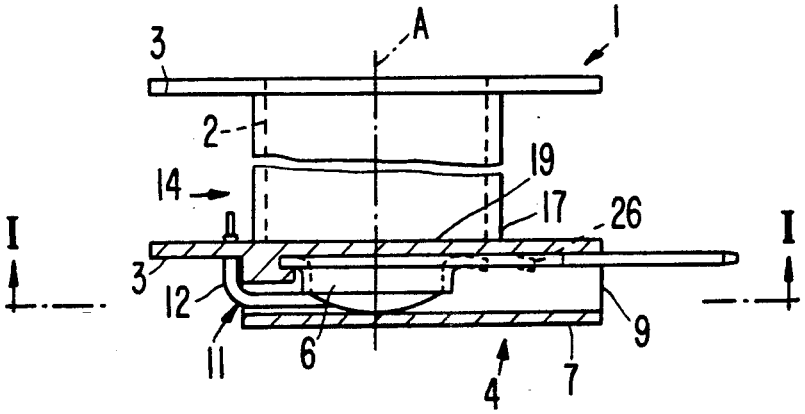
FIG. 2 is a partial cross-sectional view of the coil carrier taken along the line II—II in FIG. 1.

The inventive coil carrier 1 has a carrier core 2 and parallel boundary plates 3 bounding the core 2, so that on the latter can be applied in plates 3 a coil winding. A mount or receptacle 4 for a safety switch 6 is positioned laterally of one of the boundary plates 3. The safety switch 6 is a bimetallic excess current switch, such as a temperature monitor.

The receptacle 4 for switch 6 is constructed as a pocket, which is essentially bounded by boundary wall 3, a wall 7 running parallel thereto and longitudinal side walls 8 at right angles thereto. Receptacle 4 has an insertion opening 9 for inserting switch 6 and facing said opening 9 an opening 11 in the rear wall of receptacle 4, through which a wire 12 can be passed out of the receptacle and through a slot 13 in the winding area 14 of coil winding.

Longitudinal grooves 16 are formed in the longitudinal side walls 8, close to the boundary wall 3. Along said longitudinal groove 16, a mounting part 17 for receiving and retaining the switch 6 can be inserted into receptacle 9 of coil carrier 1. Mounting part 17 has a width corresponding to that of the receptacle 9, while taking into account of the grooves 16 and a length substantially corresponding to receptacle 9. A tongue 18 projects over the mounting part 17 over its length corresponding to that of receptacle 9, with the tongue being constructed as a flat plug and being engagable on the corresponding sockets for contacting purposes. Tongue 18 projects out of the opening 9 of receptacle 4.

Mounting part 17 has a circular opening 19, which is bounded by a circular flange 21 bent out of the plane of the flat mounting part 17. The mounting part also has a slot 23 between recess 19 and its end face 22 remote from the connecting tongue 18 and the slot assists the elasticity of the mounting part 17 in the vicinity of recess 19. Switch 6 is inserted by frictional engagement or with press fit in recess 19 and one contact thereof is formed by its casing, which as a result of the adopted arrangement is in electrical contact with the mounting part 17 and therefore with the tongue constructed in one piece therewith. For the reliable holding of mounting part 17 in receptacle 4 and particularly grooves 16, noses 26 are pressed or stamped out of the plane of mounting part 17 and prevent the latter from sliding or being pulled out of receptacle 4.

Figure 3:
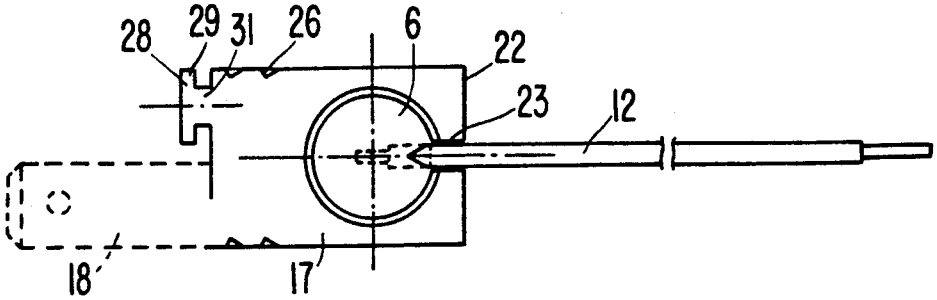
FIG. 3 is a schematic illustration of further constructions of a mounting part for the safety switch constructed in accordance with the present invention.

In the embodiment according to FIG. 3, the connecting tongue 28 has a different construction from connecting tongue 18 in the form of a flat plug and in this case it has undercuts 29, so that here contacting can be brought about, e.g. by winding a piece of wire around the tapered part 31 of connecting tongue 28. As shown in broken line form in FIG. 3, in addition it is possible to provide the connecting tongue 18 constructed as a flat plug. Optionally, one of the two connecting tongues 18, 28 can be cut off if it is not required. As a result of the inventive construction a coil carrier 1 provided with a safety switch 6 is obtained, which offers easy connection possibilities. In use, there is a reliable holding and simultaneously a reliable contacting of switch 6 via mounting part 17, which is reliably and securely held in the receptacle 4 and forms a contact for the connection of the electric power supply. The other contact of switch 6 is lead across a wire to the winding zone of the coil within coil carrier 1, so that at this point the coil can be easily connected thereto, while its other end provides the necessary contacting for power supply purposes.

I claim:

1. Coil carrier with a receptacle means for receiving a bimetallic safety switch, the coil carrier comprising an electrically conducting mounting means for mounting the bimetallic safety switch in the receptacle means, a recess means provided in said electrically conducting mounting means for frictionally engagingly receiving the bimetallic safety switch.

2. Coil carrier including a receptacle means for receiving a bimetallic safety switch, an electrically conducting mounting means for mounting the safety switch in the receptacle means, said electrically conducting mounting means includes a substantially flat plate having a recess means therein for accommodating said safety switch means, and a flange means bent out of a plane of the substantially flat plate and surrounding said recess means for frictionally engagingly holding the safety switch in said recess means.

3. Coil carrier according to one of claims 1 or 2, wherein the mounting means further includes a slot means extending from the recess means to an end face thereof for providing an elasticity in an area of the recess means.

4. Coil carrier according to one of claims 1 or 2, wherein the mounting means includes at least one nose means stamped out of a plane in a marginal region of the mounting means for preventing withdrawal of the mounting means from the receptacle means.

5. Coil carrier according to one of claims 1 or 2, wherein the mounting means includes at least one connecting tongue means projecting out of the receptacle means for enabling an establishment of an electrical contact with associated socket means.

6. Coil carrier according to claim 5, wherein the at least one connecting tongue means is constructed as a flat plug.

7. Coil carrier according to claim 5, wherein the at least one connecting tongue means includes a tapered portion formed by an undercut.

8. Coil carrier according to one of claims 1 or 2, wherein the receptacle means includes longitudinal groove means for accommodating the mounting means.

9. Coil carrier according to one of claims 1 or 2, wherein the receptacle means includes an opening on a side opposite to an insertion opening thereof through which a wire means of the safety switch is passed out and fed into a winding area of the coil carrier.

10. Coil carrier according to claim 2, wherein the safety switch is a bimetallic excess current switch.

11. A support for a coil comprising:

a receptacle means for receiving a bimetallic safety switch, said receptacle means including an insertion opening for enabling an insertion of the bimetallic safety switch, a further opening formed in a back wall at a position opposite the insertion opening for enabling a lead wire from the bimetallic safety switch to be lead out of the receptacle means, and longitudinally extending groove means formed in spaced longitudinally extending side walls at a position near a boundary wall of the coil; and an electrically conductive holder means for holding said bimetallic safety switch including a flat plate means having an opening means for receiving the bimetallic safety switch, and an annular flange bent up from a surface of said flat plate means and surrounding said bimetallic safety switch, and wherein said electrically conductive holder means with the bimetallic safety switch means received in said opening means is inserted into said insertion opening and is retained in said receptacle means by said longitudinally extending groove means.

* * * * *